US005538161A

United States Patent [19]

Koehler et al.

[11] Patent Number: 5,538,161

[45] Date of Patent: Jul. 23, 1996

[54] CONTAINER HAVING CONTENT LEVEL INDICATOR

[76] Inventors: Steven M. Koehler, 5149 Danens Dr., Edina, Minn. 55439; Lawrence C. Chasin, 3301 E. Calhoun Pkwy., Minneapolis, both of Minn. 55408

[21] Appl. No.: 286,752

[22] Filed: Aug. 5, 1994

[51] Int. Cl.[6] ..... B67D 5/22

[52] U.S. Cl. ..... 222/46; 116/200; 116/208; 222/47; 222/48; 222/156; 222/390; 401/192; 401/194

[58] Field of Search ..... 222/41, 46, 47, 222/48, 154, 156, 390; 206/459.1; 401/192, 194; 116/200, 208, 307

[56] References Cited

U.S. PATENT DOCUMENTS

| | | | |
|---|---|---|---|
| 2,921,675 | 1/1960 | Clark et al. | 206/56 |
| 3,078,011 | 2/1963 | Safianoff | 222/41 |
| 3,185,345 | 5/1965 | Hunegs | 222/390 X |
| 3,313,441 | 4/1967 | Fadden | 222/48 X |
| 4,044,889 | 8/1977 | Orentreich et al. | 206/459 |
| 4,208,144 | 6/1980 | Idec et al. | 401/192 |
| 4,579,134 | 4/1986 | Moore | 132/88.5 |
| 4,702,399 | 10/1987 | Davis | 222/390 |
| 5,137,185 | 8/1992 | Mitchell | 222/390 |
| 5,356,046 | 10/1994 | Burke | 222/156 |

FOREIGN PATENT DOCUMENTS

| | | | |
|---|---|---|---|
| 2052940 | 4/1993 | Canada | 206/459.1 |
| 0508168 | 10/1992 | European Pat. Off. | 222/156 |

*Primary Examiner*—Joseph A. Kaufman
*Attorney, Agent, or Firm*—Westman, Champlin & Kelly

[57] ABSTRACT

A container for dispensing a solid deodorant and/or antiperspirant. The container comprises a housing, a platform, a dispensing member, and a level indicator. The housing has an open top end for dispensing the deodorant and/or antiperspirant contained therein, a bottom end, and a side wall. The platform is positioned within the housing for supporting the deodorant and/or antiperspirant. The dispensing member is mounted in the housing and attached to the platform for moving the platform from the bottom end of the container towards the open top end of the container for dispensing the deodorant and/or antiperspirant. The level indicator is provided on the platform for indicating an amount of deodorant and/or antiperspirant remaining in the container, the amount of deodorant and/or antiperspirant remaining being indicated by the position of the platform as it is moved within the housing.

19 Claims, 6 Drawing Sheets

CONTAINER HAVING CONTENT LEVEL INDICATOR

BACKGROUND OF THE INVENTION

The present invention relates generally to a container such as a deodorant and/or antiperspirant container, and more particularly, to such a container having a level indicator thereon for indicating an amount of the deodorant and/or antiperspirant remaining in the container.

Solid or gel deodorant and/or antiperspirant is typically available in a push-up type container wherein rotation of a dial on the bottom of the container turns a screw which raises a platform upward with the container. As the platform is raised the deodorant or antiperspirant resting on the platform is propelled beyond the top opening of the container and is available for use.

Deodorant and/or antiperspirant is typically used daily by consumers of such products. Consumers typically either purchase a new container when the contents of old container are empty or stock up on several containers at one time to avoid missing a day when the old container empties. Level indicators such as in U.S. Pat. No. 3,078,011 provide an indication of the amount of deodorant and/or antiperspirant remaining in a particular container to assist the consumer in making economical and informed purchases of new containers. However, the device of U.S. Pat. No. 3,078,011 requires several mechanical parts, is difficult to assemble, and is expensive to manufacture.

Deodorant and/or antiperspirant containers are typically not transparent when the deodorant and/or antiperspirant is not transparent. One of the problems associated with the such non-transparent containers is that there is no simple way of accurately determining when the contents are approaching empty since it is not possible to see the level of the contents within the container. With the recent "clear is healthier" marketing schemes, the deodorant and/or antiperspirant and its containers are both transparent, but the product label often obscures the view of the platform making it difficult to determine the level of deodorant and/or antiperspirant remaining in the container. It is not desirable to use a fully transparent container with a non-transparent solid deodorant or antiperspirant for aesthetic reasons. Furthermore, non-transparent containers are desirable from a marketing standpoint since colorful containers allow the consumer to readily identify a particular brand of deodorant and/or antiperspirant.

SUMMARY OF THE INVENTION

The present invention relates to a container for dispensing a solid or gel deodorant and/or antiperspirant. The container comprises a housing, a platform, a dispensing member, and a level indicator. The housing has an open top end for dispensing the deodorant and/or antiperspirant contained therein, a bottom end, and a side wall. The platform is positioned within the housing for supporting the deodorant and/or antiperspirant. The dispensing member is mounted in the housing and attached to the platform for moving the platform from the bottom end of the container towards the open top end of the container. The level indicator is provided on the platform for indicating an amount of deodorant and/or antiperspirant remaining in the container, the amount of deodorant and/or antiperspirant remaining being indicated by the position of platform as it is moved within the housing.

In one illustrated embodiment, the housing is transparent and the level indicator includes a viewing opening cut on the side wall for viewing the platform as the platform is moved towards the open top end of the container. A label having product information thereon and a defined transparent portion is affixed to an exterior surface of the housing such that the viewing opening is visible through the transparent portion of the label.

In another illustrated embodiment, the housing is transparent and a label having product information thereon is affixed to an exterior surface of the housing such that a non-transparent portion of the label defines a viewing opening on the side wall of the housing for viewing the platform as the platform is moved towards the open top end of the container.

In another illustrated embodiment, the platform rotates on a longitudinal axis of a drive screw as the platform is moved upward within the housing. A viewing opening on the side wall of the housing enables viewing the platform as the platform is moved upward and rotated toward the open top end of the container. The platform includes markings on a sidewall so that as the platform is rotated, the visible portion of the markings changes thereby providing an indication of the amount of deodorant and/or antiperspirant remaining in the housing.

DETAILED DESCRIPTION OF THE PREFERRED EMBODIMENTS

Figure 1:
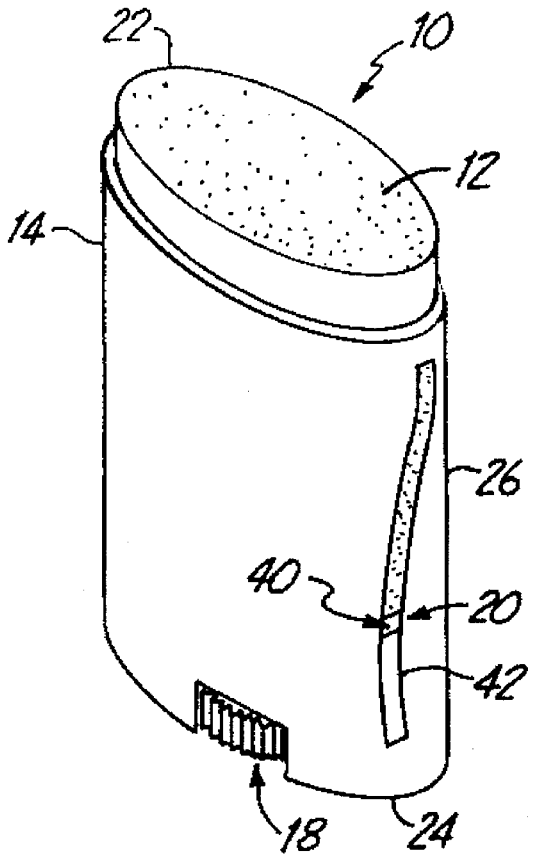
FIG. 1 is a perspective view of a deodorant and/or antiperspirant container according to the present invention.

As illustrated in FIG. 1, the present invention is a container 10 for storing and dispensing deodorant and/or antiperspirant 12 from an open end thereof. The container 10 includes a housing 14, a platform 16 (FIG. 2), a dispensing member 18, and a level indicator 20. The general construction and composition of the deodorant and/or antiperspirant 12, the housing 14, the platform 16, and the dispensing member 18 are well known in the art and may take a variety of shapes and forms.

The housing 14 is typically constructed of injection molded plastic and includes an open top end 22 for dispensing the deodorant and/or antiperspirant 12 contained therein, a bottom end 24 for supporting the dispensing member 18, and a side wall 26 for retaining the deodorant and/or antiperspirant 12.

Figure 2:
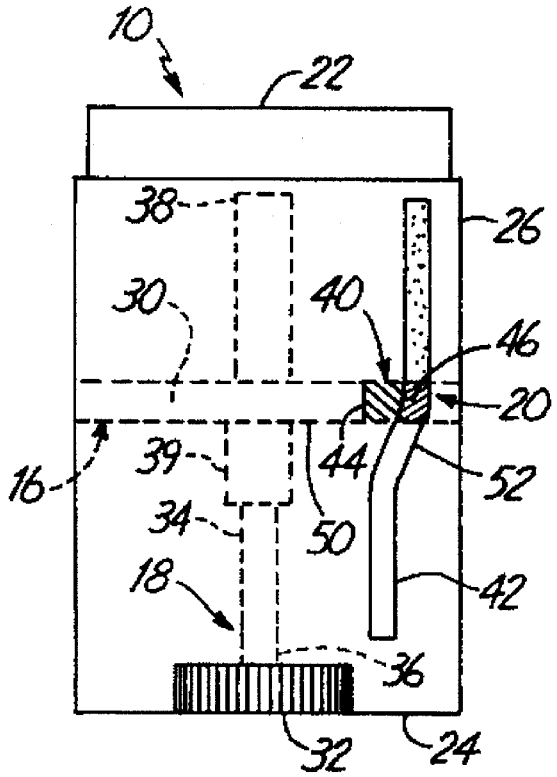
FIG. 2 is a side elevation of the container of FIG. 1 with portions broken away to illustrate the internal structure of the container.

The platform 16 is positioned within the housing 14 for supporting and propelling the deodorant and/or antiperspirant 12 within the housing 14. The platform includes a side wall 30, as illustrated in FIG. 2. The dispensing member 18 includes a rotary dial 32 and a threaded screw 34. The threaded screw 34 has a first end 36 fixedly mounted to the rotary dial 32 and second end 38 upon which the platform 16 is movably engaged. The platform 16 moves upward along the threaded screw 34 by rotation of the rotary dial 32. More particularly, turning the rotary dial 32 turns the threaded screw 34 thereby engaging a corresponding threaded portion 39 of the platform 16 for moving the platform 16 from the bottom end 24 of the housing towards the open top end 22 of the housing for dispensing the deodorant and/or antiperspirant 12.

The level indicator 20.includes level indicia markings 40 to move with the platform 16 (as illustrated formed on the side wall 30) and a viewing opening 42 on the side wall 26 for viewing the level indicia markings 40. The level indicia markings 40 indicate an amount of deodorant and/or antiperspirant 12 remaining in the container 10 so that the user is alerted to purchase new containers before the current container is exhausted. The amount of deodorant and/or antiperspirant 12 remaining in the container 10 is indicated by the position of platform 16 along the side wall 26 of the housing as it is moved within the housing 14.

As illustrated in FIGS. 1 and 2, the viewing opening 42 extends down a length of the side wall 26. The level indicia markings 40 include a first indicator marking 44 indicating the amount of deodorant and/or antiperspirant 12 in the housing 14 to be at a first level, and a second level indicator marking 46 indicating the amount of deodorant and/or antiperspirant 12 to be at a second level. The first and second level indicator markings 44 and 46 are positioned parallel to each other and generally perpendicular to a base edge 50 of the platform 16. The viewing opening 42 has a generally rectangular shape and is bent at a middle section 52 so that the first indicator marking 44 is visible through the viewing opening 42 when the deodorant and/or antiperspirant 12 is substantially full, and so that the second indicator marking 46 is visible through the viewing opening 42 when the deodorant and/or antiperspirant 12 is near empty.

In a preferred embodiment the first and second indicator markings 44 and 46 are colored areas on the platform 16. When multiple indicator markings are provided the colors are different, preferably, green for "full" and red for "empty". Additionally, the indicator markings may comprise a gradual color variant from a first color to a second color. Of course, other indicator markings such as the words "empty" or "full" may be provided in place of the color indicators.

FIGS. 3–10 illustrate additional embodiments of the present invention. Elements in FIGS. 3–10 corresponding to elements in FIGS. 1 and 2 are illustrated with the same reference numerals as in FIGS. 1 and 2, increased by one-hundred, two-hundred, three-hundred, etc. for each embodiment. Unless otherwise stated, the elements in FIGS. 3–10 function the same as the corresponding elements in FIGS. 1 and 2.

Figure 3:
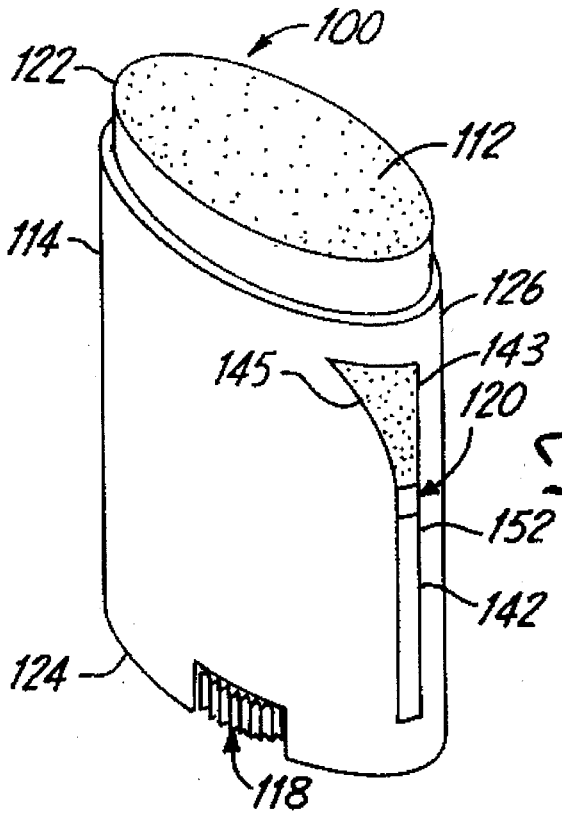
FIG. 3 is a perspective view of a second embodiment of the deodorant and/or antiperspirant container according to the present invention.
Figure 4:
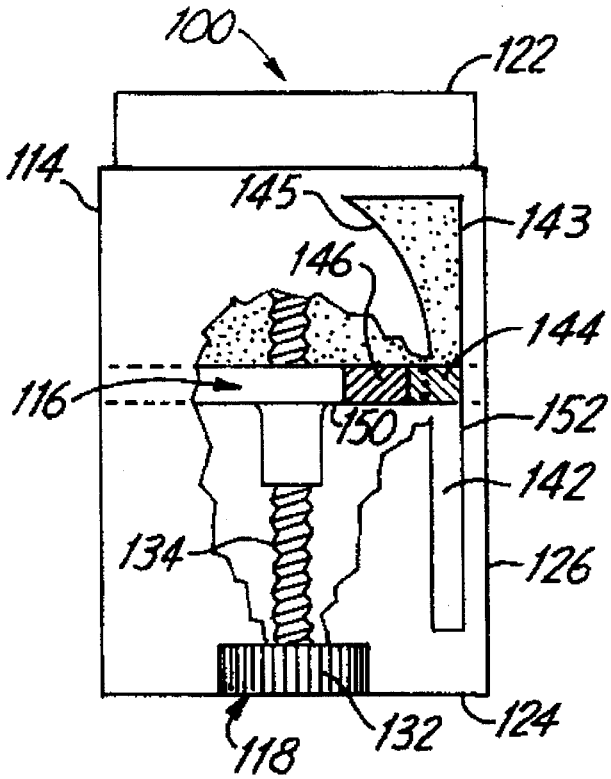
FIG. 4 is a side elevation of the container of FIG. 3 with portions broken away to illustrate the internal structure of the container.

As illustrated in FIGS. 3 and 4, the first and second level indicator markers 144 and 146 are positioned parallel to each other and generally perpendicular to a base edge 150 of the platform 116 as in FIGS. 1 and 2. However, a width of the viewing opening 142 increases at the top end 122 of the housing such that when the platform 116 is in a first position (e.g. at the bottom end 124 and middle section 152 of the housing) the first level indicator 144 is visible through the viewing opening 142, and such that when the platform 116 is in a second position (e.g. at the top end 122 of the housing) the first and the second level indicators 144 and 146 are visible through the viewing opening 142. More particularly, the shape of the viewing opening 142 includes a first straight edge 143 running along the length of the side wall 126 of the housing and a second edge 145 running parallel to the first straight edge 143 adjacent the bottom end 124 and middle section 152 of the housing and being flared inwardly toward a center plane bisecting the container 100 as the second edge 145 approaches the top end 122 of the housing 114.

Figure 5:
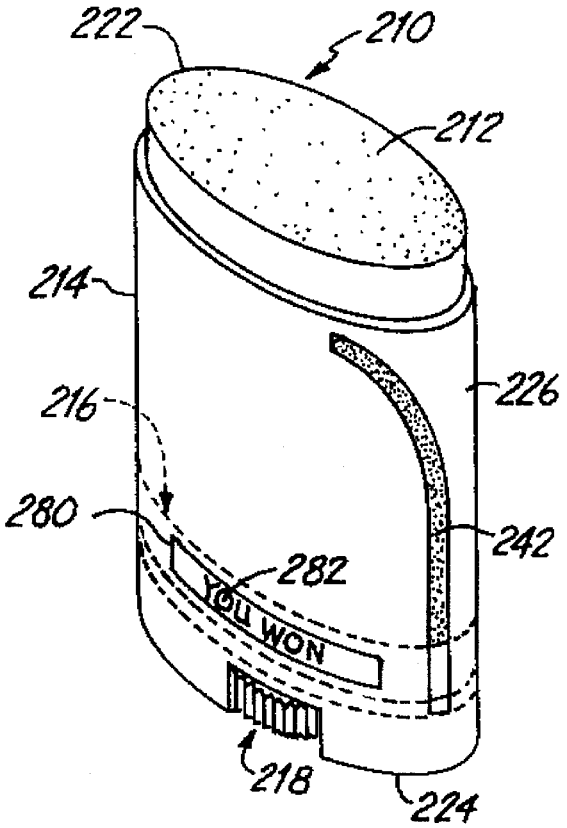
FIG. 5 is a perspective view of a third embodiment of the deodorant and/or antiperspirant container according to the present invention.
Figure 6:
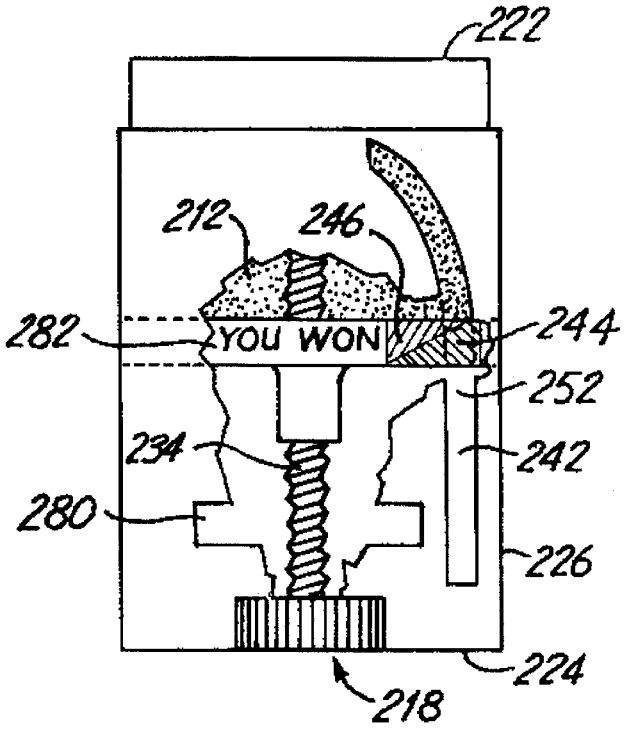
FIG. 6 is a side elevation of the container of FIG. 5 with portions broken away to illustrate the internal structure of the container.

As illustrated in FIGS. 5 and 6, the shape of the viewing opening 242 is also bent such that the first indicator marker 244 is visible through the viewing opening 242 when the deodorant and/or antiperspirant 212 is "full", and so that the second indicator marking 246 is visible through the viewing opening 242 when the deodorant and/or antiperspirant 212 is "empty". However, the entire portion of the viewing opening 242 adjacent the top end 222 of the housing is bent, as compared to the only the bent middle section in FIGS. 1 and 2, and as compared to the upper flared portion in FIGS. 3 and 4. In FIGS. 5 and 6, the first and second indicator markings 244 and 246 comprise a gradual color gradient from a "full" color indicator, such as the color "green" to an "empty" color indicator, such as the color "red". The color gradient is offset so that the "empty" indicator begins to be visible as the viewing opening 242 begins to bend in the top section of the side wall 226 of the housing.

FIGS. 5 and 6 also illustrate a message display opening 280 operable with the platform 216 to view message indicia 282 on the platform 216 such as for use in a "game of chance". The "game of chance" may indicate whether or not the user or purchaser of the container 210 has won a random prize, by providing message indicia 282 such as the words "You Win!" or "Sorry, You Lose". The message indicia 282 is printed on the platform 216 and the message display opening 280 is positioned adjacent the bottom end 224 of the housing such that the message indicia 282 is visible before one-third of the deodorant and/or antiperspirant 212 is dispensed. Although the display opening 280 could be disposed at any position along a longitudinal axis of a drive screw 234, it is believed a location closer to the bottom of the container 214 (when the container 214 is generally full) is preferable since the consumer need not wait for the platform 216 to advance too far as the deodorant and/or antiperspirant is used in order to see if they have won. Likewise, the consumer need not push a substantial quantity of the deodorant and/or antiperspirant out of the container 214 only to retract it back within the container 214 once they have determined if they won.

Figure 7A:
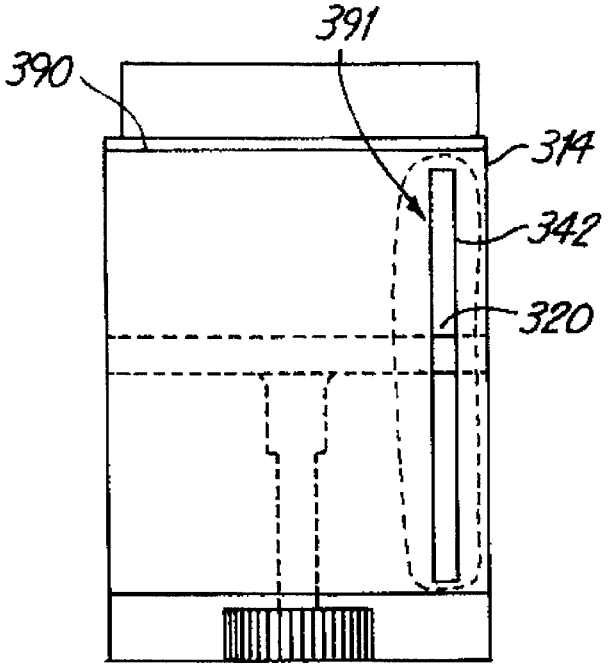
FIG. 7A is a side elevational view of a fourth embodiment of the container according to the present invention.
Figure 7B:
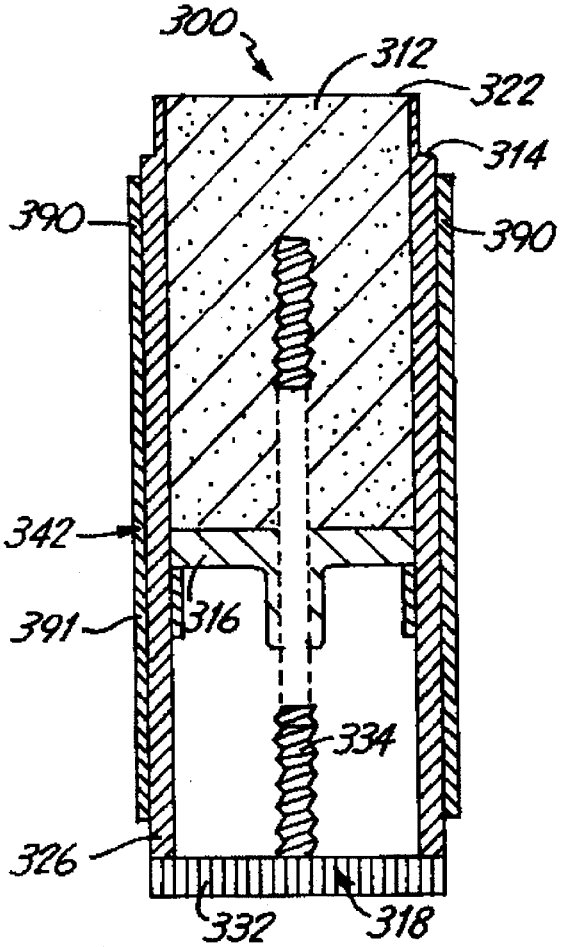
FIG. 7B is a sectional view of the fourth embodiment of the container according to the present invention.
Figure 8:
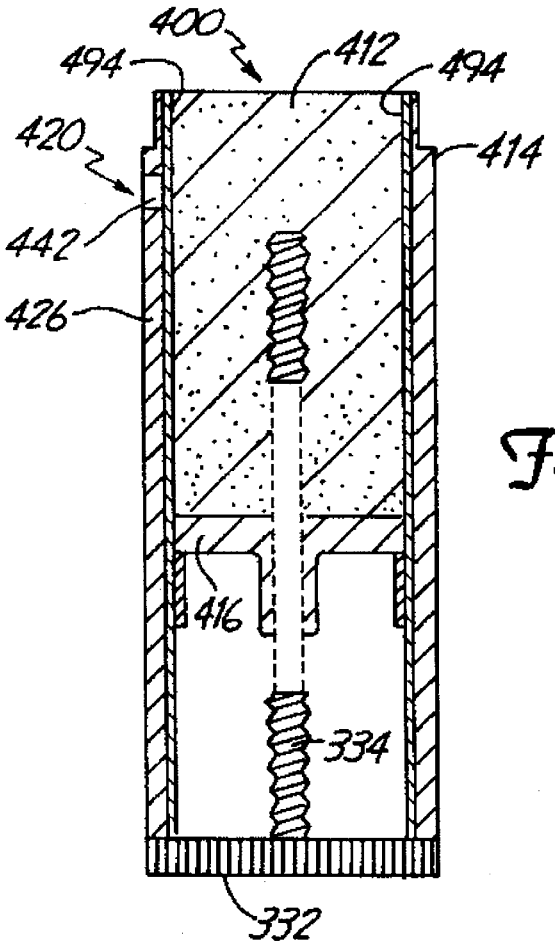
FIG. 8 is a sectional view of a fifth embodiment of the container according to the present invention.
Figure 9:
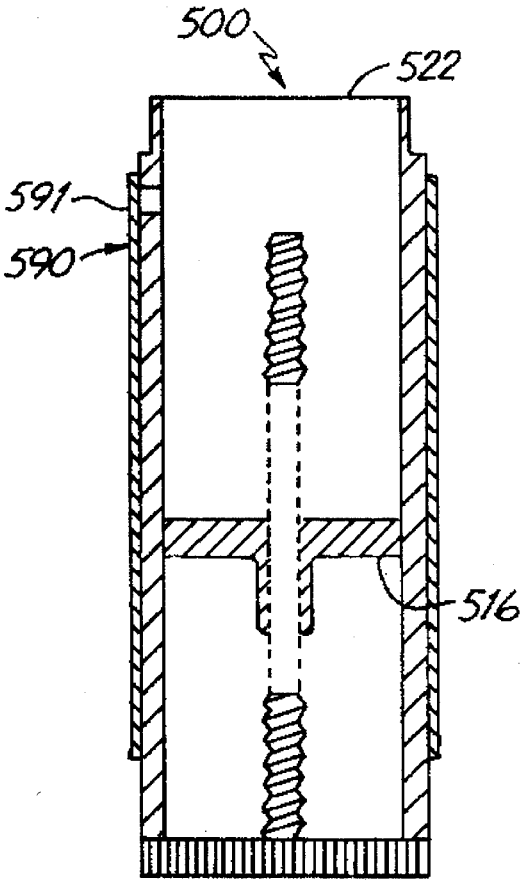
FIG. 9 is a sectional view of a sixth embodiment of the container according to the present invention.

FIGS. 7–9 illustrate several different ways of constructing viewing openings. In the embodiment of FIGS. 7A and 7B, a housing 314 is constructed of a transparent material. Typically, transparent housings 314 are used with clear deodorant and/or antiperspirant 312. A product label 390 having product information thereon is affixed to an exterior surface of the housing 314. The level indicator means 320 includes a non-transparent portion 391 of the product label 390 defining a viewing opening 342 on the side wall 326 of the housing for viewing the platform 316 as the platform 316 is moved toward the open top end 322 of the housing 314.

Referring to FIG. 8, the housing 414 is constructed of a non-transparent material. The level indicator 420 includes a viewing opening 442 cut in the side wall 426 for viewing the platform 416 as the platform is moved towards the open top end 422 of the housing 414. In FIG. 8, the viewing opening 442 is illustrated as a small aperture since it may correspond, for example, to an upper portion of the opening 242 in FIG. 5. A transparent insert 494 may be used to prevent the deodorant and/or antiperspirant 412 from seeping into the viewing opening 442. The transparent insert 494 is secured over the viewing opening 442 in the interior of the housing. The transparent insert 494 may be a sleeve into which the deodorant and/or antiperspirant 412 is formed during manufacture. If desired, the transparent insert 494 could be a suitable transparent film that is attached to an inner surface of the housing 414. Likewise, the insert could be a suitable transparent plug that fills the opening 442 and engages a surface of the housing 414.

Referring to FIG. 9, the housing 514 is also constructed of a non-transparent material. The level indicator 520 includes a viewing opening 542 formed in the side wall 526 for viewing the platform 516 as the platform 516 is moved towards the open top end 522 of the container 500. A product label 590 is affixed to an exterior surface of the housing 514 such that the viewing opening 542 is visible through a transparent portion 591 of the product label 590.

Figure 10A:
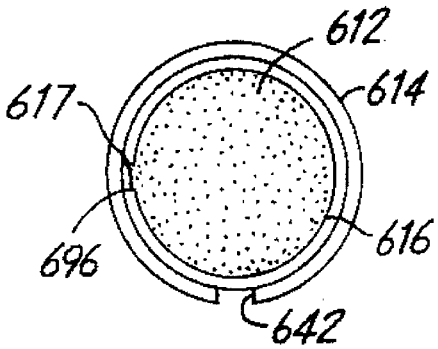
FIG. 10A is a top plan of a seventh embodiment of the container according to the present invention.
Figure 10B:
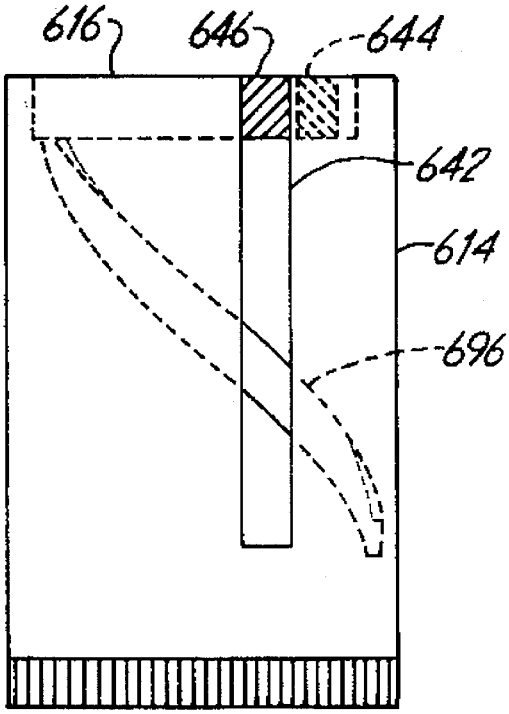
FIG. 10B is a side elevational view of the seventh embodiment.
Figure 10C:
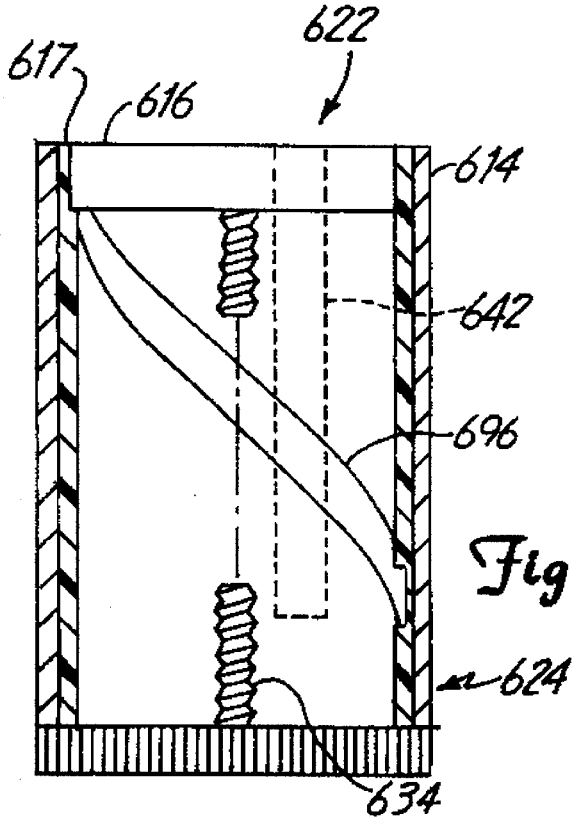
FIG. 10C is a sectional view of the seventh embodiment.

As illustrated in FIGS. 10A, 10B and 10C, a housing 614 is cylindrical. A guide channel 696 on the interior of the housing 614 in cooperation with a suitable pin 617 secured to and preferably integral with a platform 616 causes the platform 616 to rotate around a longitudinal axis of a drive screw 634 as the platform 616 moves up and down within the housing 614. The guide channel 696 is selected such that the platform 616 makes, at most, a single revolution as the platform 616 extends from a bottom end 624 of the housing 614 to a top end 622. A level indicator 620 includes a viewing opening 642 on a portion of a side wall of the housing 614. The viewing opening 642 allows a portion of the platform 616 to be seen as the platform 616 is moved upward toward the open top end of the housing 614, while being rotated about the drive screw 634. Indicator markings 644 and 646 are provided on a portion of the platform 616 and comprise a color change from a "full" color indicator, such as the color "green" to an "empty" color indicator, such as the color "red". The indicator markings 644 and 646 are positioned so that as the platform 616 rotates a different portion of the indicator markings are seen through the viewing opening 642 as the platform 616 moves upwardly. In other words, if the guide channel 696 causes the platform 616 to rotate 90 degrees, then the indicator markings 644 and 646 are disposed on one-quarter of the circumference of the side wall of the platform 616.

Preferably, as illustrated, the guide channel 696 is helical having a pitch substantially greater than the pitch of the threads on the drive screw 634. In this manner, although rotation of the platform 616 within the housing 614 is in the same direction as that of the drive screw 634, the platform 616 is still forced upward since the drive screw 634 turns many times for the one or partial revolution of the platform 616.

In the embodiment illustrated, the guide channel 696 is formed in a transparent insert 650 that is secured to an inner surface of the housing 614. Since the viewing opening 642 is formed in the housing 614 the deodorant and/or antiperspirant 612 will not rub against the edges of the viewing opening 642. The other constructions described above could also be used if desired. Likewise, the guide channel 696 could be formed in the housing 614 with a suitable transparent covering layer, such as a film, to cover the viewing opening 642 and a portion adjacent or all of the inner or outer surfaces of the housing 614.

Although the present invention has been described with respect to the illustrated embodiments, those skilled in the art will recognize that changes may be made in form and detail without departing from the spirit and scope of the invention.

What is claimed is:

1. A container for dispensing a solid deodorant comprising:

a housing having an open top end for dispensing the deodorant contained therein, a bottom end, and a side wall having a viewing opening formed therein;

a platform positioned within the housing for supporting the deodorant, the platform having a base edge, a side surface and a top surface, the deodorant being supported on the top surface of the platform, the base edge and the side surface of the platform being visible through the viewing opening as the platform is moved towards the open top end of the container;

a dispensing mechanism mounted in the housing and attached to the platform for moving the platform from the bottom end of the container towards the open end of the container along an axis for dispensing the deodorant; and a level indicator marking provided on the side surface of the platform about said axis and operable with the viewing opening for indicating an amount of deodorant remaining in the container, wherein a portion of the base edge about said axis seen through the viewing opening varies as a function of the platform being moved within the viewing opening.

2. The container of claim 1, wherein the housing is non-transparent.

3. The container of claim 2, wherein the viewing opening extends down a length of the side wall.

4. The container of claim 2, further comprising a label having product information thereon and a defined transparent portion, the label being affixed to an exterior surface of the housing such that the viewing opening is visible through the transparent portion of the label.

5. The container of claim 1, wherein the viewing opening bends along a curved path such that when the platform is in a first position a first portion of the level indicator marking is visible through the viewing opening, and such that when the platform is in a second position a second portion of the level indicator marking is visible through the viewing opening.

6. The container of claim 1, wherein the viewing opening bends along a curved path such that when the platform is in a first position a first portion of the level indicator marking is visible through the viewing opening, and such that when the platform is in a second position the first portion of the level indicator marking and a second portion of the level indicator are visible through the viewing opening.

7. The container of claim 1, wherein the the level indicator marking comprises a gradual color variant from a first color to a second color.

8. The container of claim 1, wherein the housing is transparent.

9. The container of claim 8, further comprising a non-transparent label having product information thereon, the label being affixed to an exterior surface of the housing defining the viewing opening on the side wall of the housing for viewing the platform as the platform is moved towards the open top end of the container.

10. The container of claim 9, wherein the level indicator marking includes a first indicator marker indicating the amount of deodorant in the housing to be at a first level, and a second level indicator marker indicating the amount of deodorant to be at a second level.

11. The container of claim 10, wherein the viewing opening bends along a curved path such that when the platform is in a first position the first level indicator marker is visible through the viewing opening, and such that when the platform is in a second position the second level indicator marker is visible through the viewing opening.

12. The container of claim 10, wherein the viewing opening bends along a curved path such that when the platform is in a first position the first level indicator marker is visible through the viewing opening, and such that when the platform is in a second position the first and the second level indicator markers are visible through the viewing opening.

13. The container of claim 1, further comprising a message display opening operable with the platform to view message indicia on the platform.

14. The container of claim 13, wherein the message display opening is positioned adjacent the bottom of the container.

15. The container of claim 14, wherein the message indicia is visible before one-third of the deodorant is dispensed.

16. The container of claim 1, and means for rotating the platform about a vertical axis as the platform moves up and down within the housing.

17. A container for dispensing a solid deodorant or antiperspirant comprising:

a housing having an open top end for dispensing the deodorant or antiperspirant contained therein, a bottom end, and a side wall, the side wall having a viewing opening formed therein and extending down a length thereof and a separate message display opening formed therein;

a platform positioned within the housing, the platform having a side surface and a top surface, the deodorant or antiperspirant being supported on the top surface of the platform;

a dispensing mechanism mounted in the housing having a screw attached to the platform for moving the platform from the bottom end of the container towards the open end of the container for dispensing the deodorant or antiperspirant, the side surface being formed about the screw;

a level indicator marking provided on the side surface about the screw and operable with the viewing opening for indicating an amount of deodorant or antiperspirant remaining in the container, wherein a portion of the level indicator about the screw seen through the viewing opening varies as a function of the platform being moved within the housing; and message indicia on the side surface for indicating a message, the message indicia being visible through the message display opening as the platform is moved towards the open top end of the container.

18. The container of claim 17, wherein the level indicator marking includes a plurality of level indicator markings provided on the platform such that the amount of deodorant or antiperspirant remaining is indicated by varying visibility of the plurality of level indicator markings through the viewing opening as a function of the platform being moved within the viewing opening.

19. A container for dispensing a solid deodorant or antiperspirant comprising:

a housing having an open top end for dispensing the deodorant or antiperspirant contained therein, a bottom end, and a side wall, the side wall having a viewing opening formed therein and extending down a length thereof and a separate message display opening formed therein;

a platform positioned within the housing, the platform having a side surface and a top surface, the deodorant or antiperspirant being supported on the top surface of the platform;

a dispensing mechanism mounted in the housing attached to the platform for moving the platform from the bottom end of the container towards the open end of the container for dispensing the deodorant or antiperspirant;

a level indicator marking provided on the side surface and operable with the viewing opening for indicating an amount of deodorant or antiperspirant remaining in the container as a function of the platform being moved within the housing; and message indicia on the side surface for indicating a message, the message indicia being visible through the message display opening as the platform is moved towards the open top end of the container.

* * * * *